US009943171B1

(12) United States Patent
Simpson

(10) Patent No.: US 9,943,171 B1
(45) Date of Patent: Apr. 17, 2018

(54) REMOVEABLE WHEELCHAIR WEATHER SHIELD

(71) Applicant: Shirley Simpson, Princeton, IL (US)

(72) Inventor: Shirley Simpson, Princeton, IL (US)

( * ) Notice: Subject to any disclaimer, the term of this patent is extended or adjusted under 35 U.S.C. 154(b) by 0 days.

(21) Appl. No.: 15/478,311

(22) Filed: Apr. 4, 2017

(51) Int. Cl.
*A47C 7/66* (2006.01)

(52) U.S. Cl.
CPC ..... *A47C 7/66* (2013.01)

(58) Field of Classification Search
CPC ..... A47C 7/66; A61G 5/10
See application file for complete search history.

(56) References Cited

U.S. PATENT DOCUMENTS 4,093,305 A * 6/1978 Staroste ..... A45B 23/00 297/184.17
4,643,479 A 2/1987 Servi
5,022,420 A * 6/1991 Brim ..... A01D 67/02 135/161
5,168,889 A 12/1992 Diestel
5,301,975 A * 4/1994 Rivera ..... A61G 5/10 135/88.01
5,511,259 A * 4/1996 Tarara ..... A47C 7/66 135/133
D403,503 S 1/1999 Evans
5,921,258 A 7/1999 Francois
6,076,206 A * 6/2000 Celaya ..... A47C 29/003 135/119
6,592,988 B1 * 7/2003 Thompson ..... C08K 5/0075 252/8.62
6,764,133 B2 * 7/2004 Osato ..... A47D 13/102 297/184.13
6,789,557 B1 * 9/2004 Wahl, Jr. ..... A47C 7/66 135/117
7,118,173 B2 * 10/2006 Kassai ..... B62B 9/14 135/133
7,140,678 B1 11/2006 Grant
7,243,990 B1 * 7/2007 Wahl ..... A47C 7/66 297/184.15
7,316,450 B2 1/2008 Ayers
7,963,596 B2 * 6/2011 Efthimiou ..... A47C 7/66 297/184.1
8,287,038 B2 * 10/2012 Henderson ..... B62B 9/142 280/47.38
9,451,830 B1 * 9/2016 Buzzella ..... A47C 7/66
2010/0078053 A1 4/2010 Hughes

FOREIGN PATENT DOCUMENTS

NO 2014139297 A1 9/2014

* cited by examiner

*Primary Examiner* — Noah Chandler Hawk

(57) ABSTRACT

The removable wheelchair weather shield is a shelter. The removable wheelchair weather shield attaches in a removable manner to a wheelchair. The removable wheelchair weather shield protects an occupant of the wheelchair from the weather. The removable wheelchair weather shield includes a canopy and a support structure. The canopy forms a hood over the occupant. The canopy is formed in the shape of an arch. The supporting structure: 1) attaches the canopy to the wheelchair; and 2) raises the canopy above the occupant of the wheelchair.

2 Claims, 5 Drawing Sheets

REMOVEABLE WHEELCHAIR WEATHER SHIELD

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of furniture including chairs, more specifically, an accessory for a wheelchair that protects the occupant against weather.

SUMMARY OF INVENTION

The removable wheelchair weather shield is a shelter. The removable wheelchair weather shield attaches in a removable manner to a wheelchair. The removable wheelchair weather shield protects an occupant of the wheelchair from the weather. The removable wheelchair weather shield comprises a canopy and a support structure. The canopy forms a hood over the occupant. The canopy is formed in the shape of an arch. The supporting structure: 1) attaches the canopy to the wheelchair; and 2) raises the canopy above the occupant of the wheelchair.

These together with additional objects, features and advantages of the removable wheelchair weather shield will be readily apparent to those of ordinary skill in the art upon reading the following detailed description of the presently preferred, but nonetheless illustrative, embodiments when taken in conjunction with the accompanying drawings.

In this respect, before explaining the current embodiments of the removable wheelchair weather shield in detail, it is to be understood that the removable wheelchair weather shield is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the removable wheelchair weather shield.

It is therefore important that the claims be regarded as including such equivalent construction insofar as they do not depart from the spirit and scope of the removable wheelchair weather shield. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
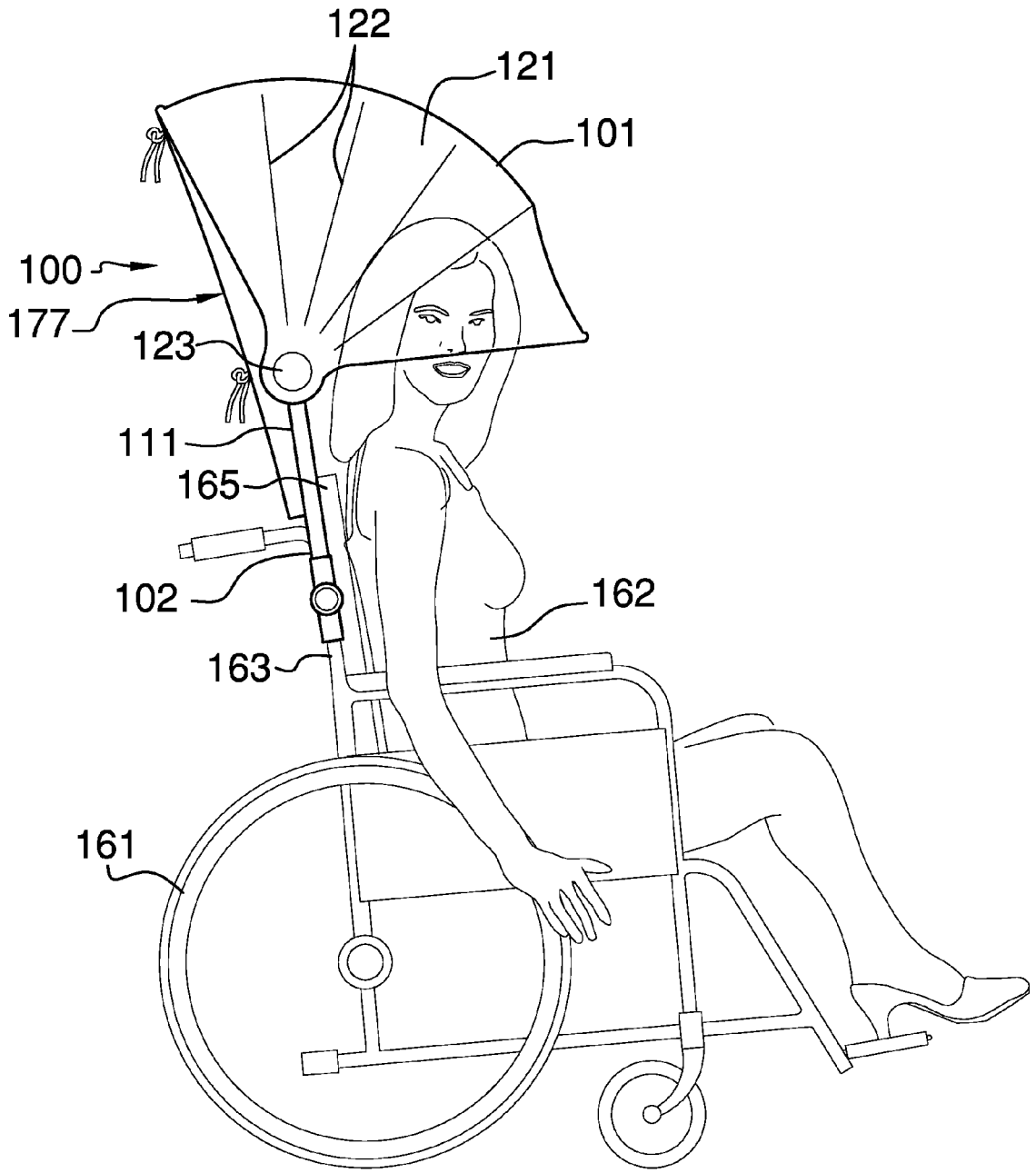
FIG. 1 is an in use view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 6.

The removable wheelchair weather shield 100 (hereinafter invention) comprises a canopy 101 and a support structure 102. The canopy 101 forms a hood over the occupant 162. The canopy 101 is formed in the shape of an arch 124. The supporting structure: 1) attaches the canopy 101 to the wheelchair 161; and 2) raises the canopy 101 above the occupant 162 of the wheelchair 161. The invention 100 is a shelter. The invention 100 attaches in a removable manner to a wheelchair 161. The invention 100 protects an occupant 162 of the wheelchair 161 from the weather. The wheelchair 161 further comprises right back cane 163, a left back cane 164, and a backrest 165. The right back cane 163 is a vertical support that is attached to the backrest 165 of the wheelchair 161 along the right side of the occupant 162. The left back cane 164 is a vertical support that is attached to the backrest 165 of the wheelchair 161 along the left side of the occupant 162.

The canopy 101 comprises a sheeting 121, a sheeting frame 122, and a plurality of pivots 123.

The sheeting 121 is a material selected from the group consisting of a plastic sheeting, a textile sheeting, or a composite textile sheeting. Methods to make sheetings are well known and documented in the textile and chemical arts. It is preferred that a textile sheeting be treated with perfluorobutanesulfonic acid (CAS 375-73-5). It is preferred that a composite textile sheeting be treated with perfluorobutanesulfonic acid (CAS 375-73-5). The sheeting 121 is a flexible structure that provides a barrier between the occupant 162 and the weather such that the sheeting 121 will protect the occupant 162 from the weather.

The sheeting 121 mounts on a sheeting frame 122. The sheeting frame 122 is a collapsible structure formed in the shape of an arch 124. The sheeting 121 is stretched over the sheeting frame 122 such that the sheeting 121 forms the exterior surface of the sheeting frame 122. Depending on the requirements of the occupant 162, the sheeting frame 122 extends and retracts that sheeting 121 over the occupant 162.

Figure 2:
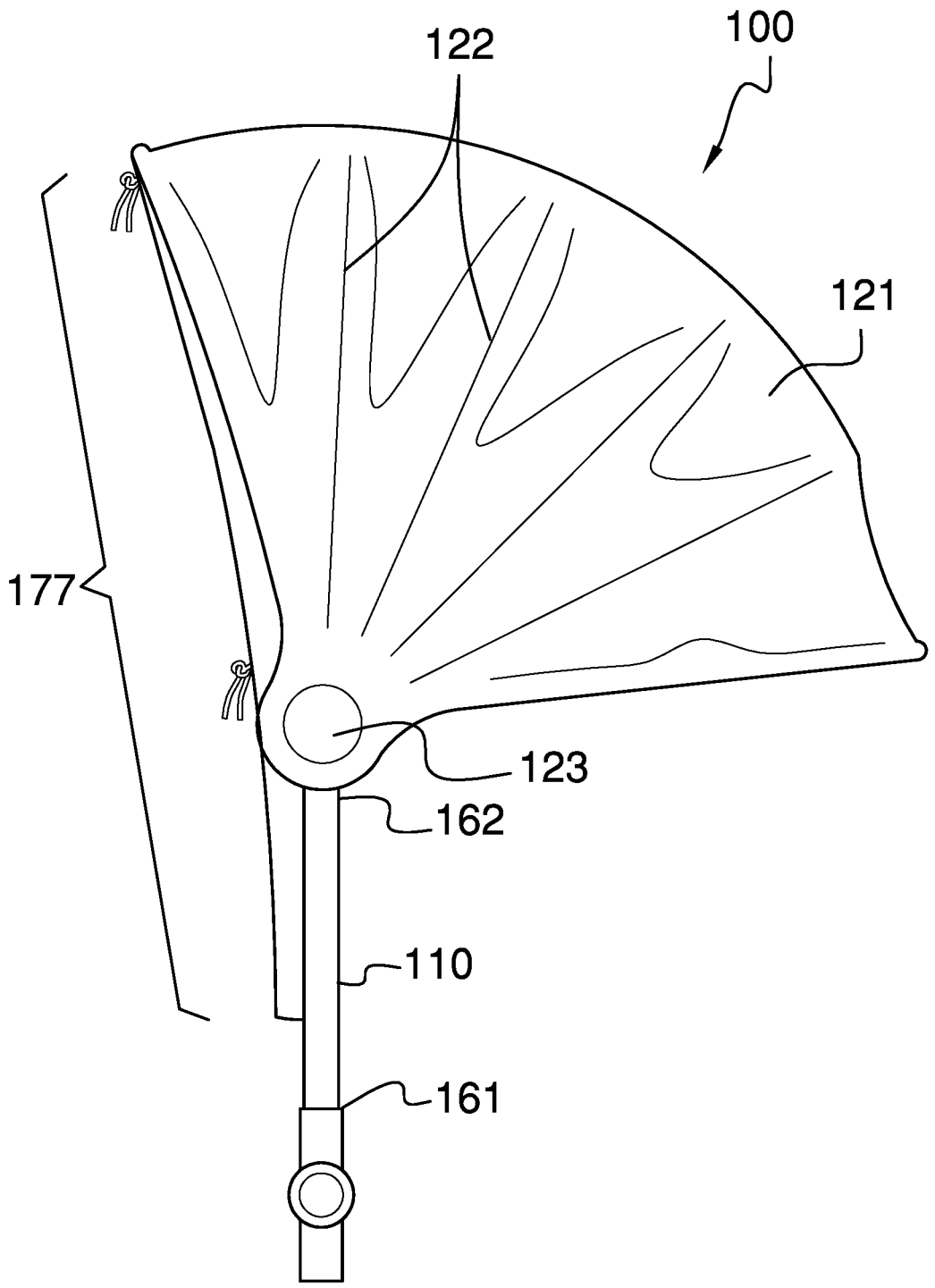
FIG. 2 is a side view of an embodiment of the disclosure.
Figure 4:
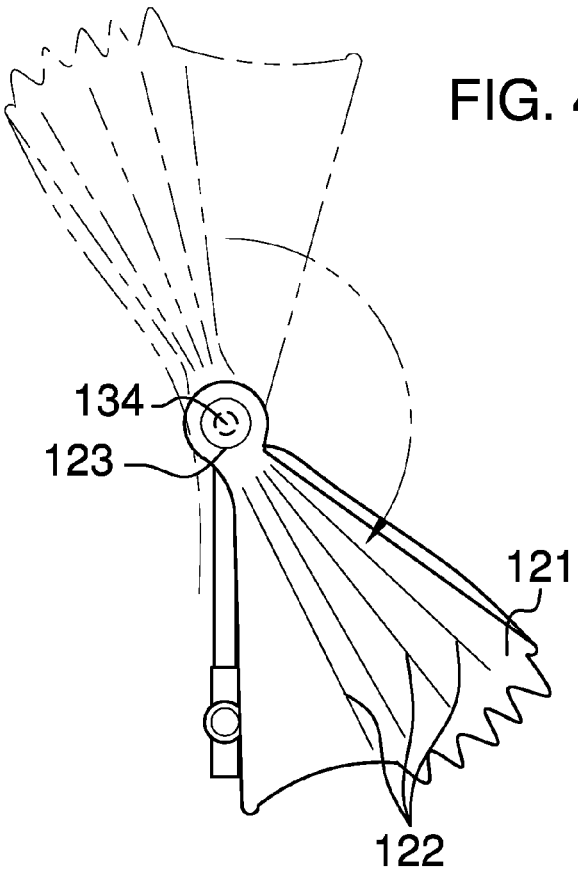
FIG. 4 is a detail view of an embodiment of the disclosure.
Figure 5:
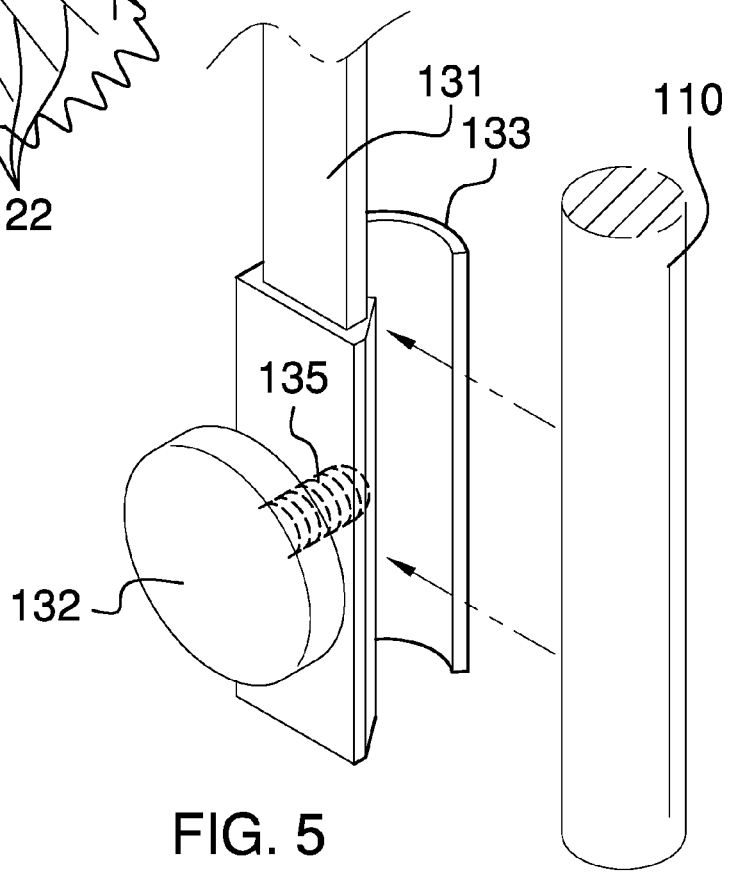
FIG. 5 is a detail view of an embodiment of the disclosure.
Figure 6:
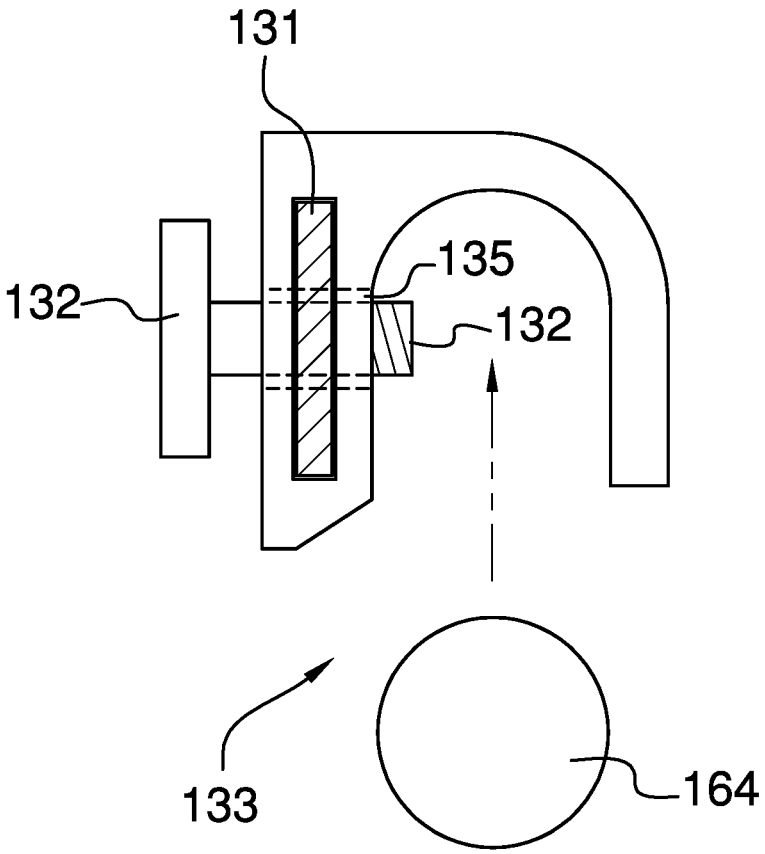
FIG. 6 is a detail view of an embodiment of the disclosure.

As shown most clearly in FIGS. 2 and 4, the sheeting frame 122 folds the sheeting 121 in the manner of an accordion fold. The sheeting frame 122 attaches to the support structure using a plurality of pivots 123. Each of the plurality of pivots 123 is a readily and commercially available locking pivot that attaches the sheeting frame 122 to a clamp of the supporting structure 102 selected from the group consisting of the first clamp 111 and the second clamp 112. The first clamp 111 and the second clamp 112 are discussed elsewhere in this disclosure. The pivot 123 attaches the sheeting frame 122 to the selected clamp in a manner that allows the sheeting frame 122 to rotate around the pivot 123 using the center axis of the pivot 123 as the center of rotation of the sheeting frame 122. The pivot 123 can be a shaft, a bearing, a hinge, or some combination thereof.

The support structure 102 comprises a collection of individual clamps 110. In the first potential embodiment of the disclosure, the support structure 102 comprises a first clamp 111 and a second clamp 112. Each individual clamp 110 comprises a stanchion 131, a thumbscrew 132, an envelope 133, a pivot aperture 134, and a thumbscrew aperture 135. The stanchion 131 is a vertical structure that raises the canopy 101 above the horizontal surface that the wheelchair 161 is placed on and above the occupant 162 of the wheelchair 161. The stanchion 131 is further defined with a first end 141 and a second end 142. The second end 142 is formed with the pivot aperture 134.

Figure 3:
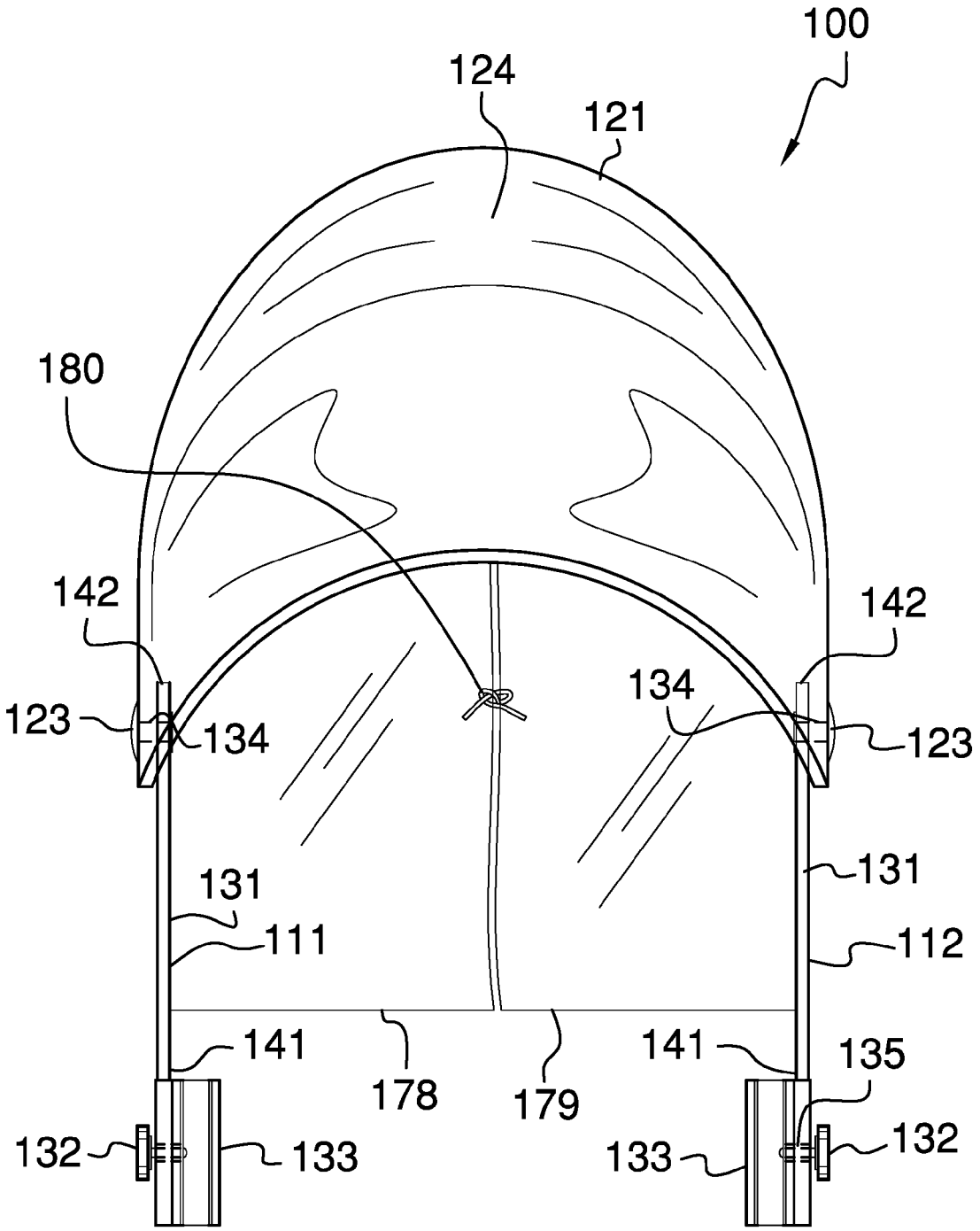
FIG. 3 is a front view of an embodiment of the disclosure.

As shown most clearly in FIG. 3, the pivot aperture 134 is an aperture formed through the stanchion 131 such that the pivot 123: 1) can be inserted into the pivot aperture 134; and, 2) can be supported by the stanchion 131. The first end 141 of the stanchion 131 attaches to the envelope 133. The envelope 133 is a structure that attaches to a cane selected from the group consisting of the right back cane 163 of the wheelchair 161 or the left back cane 164 of the wheelchair 161. As shown most clearly in FIG. 5, the structure of the envelope 133 is such that the envelope 133 will surround a portion of the selected cane in such a manner that the thumbscrew 132 can be screwed into the selected cane to secure the envelope 133 into position. Also shown in FIG. 5, the thumbscrew hole 135 is formed in the envelope 133. The thumbscrew hole 135 is a threaded aperture through which the thumbscrew 132 can be threaded to form a threaded connection that presses into the selected cane. The use of a thumbscrew 132 as a detent mechanism is well known and documented in the mechanical arts.

To use the first potential embodiment of the disclosure, the first clamp 111 is attached to the right back cane 163 such that the canopy 101 is vertically above the occupant 162. The second clamp 112 is attached to the left back cane 164 such that the canopy 101 is vertically above the occupant 162. The sheeting frame 122 is extended or retracted as desired by the occupant 162. The sheeting frame 122 is rotated around the pivot 123 as desired by the occupant 162. When the use of the first potential embodiment of the disclosure is completed, the first clamp 111 and the second clamp 112 are removed from their respective canes.

The invention 100 may also include a rear canopy 177. The rear canopy 177 extends across the span formed between the first clamp 111 and the second clamp 112. The rear canopy 177 is further defined with a first, rear canopy 178 and a second, rear canopy 179. The first, rear canopy 178 is affixed to the first clamp 111; whereas the second, rear canopy 179 is affixed to the second clamp 112. A drawstring 180 is provided to secure the first, rear canopy 178 to the second, rear canopy 179.

The following definitions were used in this disclosure:

Accordion Fold: As used in this disclosure, an accordion fold is a pleated structure that resembles the bellows of an accordion.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or cone like structure. When the center axes of two cylinder or like structures share the same line they are said to be aligned. When the center axes of two cylinder like structures do not share the same line they are said to be offset.

Center of Rotation: As used in this disclosure, the center of rotation is the point of a rotating plane that does not move with the rotation of the plane. A line within a rotating three-dimensional object that does not move with the rotation of the object is referred to as an axis of rotation.

Composite Textile: As used in this disclosure, a composite textile is a multilayer fabric made of two or more joined layers of textile or sheeting materials.

Cylinder: As used in this disclosure, a cylinder is a geometric structure defined by two identical flat and parallel ends, also commonly referred to as bases, which are circular in shape and connected with a single curved surface, referred to in this disclosure as the face. The cross section of the cylinder remains the same from one end to another. The axis of the cylinder is formed by the straight line that connects the center of each of the two identical flat and parallel ends of the cylinder. In this disclosure, the term cylinder specifically means a right cylinder, which is defined as a cylinder wherein the curved surface perpendicularly intersects with the two identical flat and parallel ends.

Detent: As used in this disclosure, a detent is a device for attaching a first object to a second object in a detachable manner such that: 1) the relative position of the first object relative to the second object is adjustable; and, 2) the first object is attached to the second object in a detachable manner.

Exterior: As used in this disclosure, the exterior is use as a relational term that implies that an object is not contained within the boundary of a structure or a space.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Interior: As used in this disclosure, the interior is use as a relational term that implies that an object is contained within the boundary of a structure or a space.

Perfluorobutanesulfonic acid: As used in this disclosure, perfluorobutanesulfonic acid (CAS 375-73-5) is a surfactant, technically a fluorosurfactant, which is commonly applied to a textile as a water repellant.

Pivot: As used in this disclosure, a pivot is a rod or shaft around which an object rotates or swings.

Sheeting: As used in this disclosure, sheeting is a material, such as a textile, a plastic, or a metal foil, in the form of a thin flexible layer or layers.

Stanchion: As used in this disclosure, a stanchion refers to an upright pole, post, or support.

Textile: As used in this disclosure, a textile is a material that is woven, knitted, braided or felted. Synonyms in common usage for this definition include fabric and cloth.

Threaded Connection: As used in this disclosure, a threaded connection is a type of fastener that is used to join a first tube shaped and a second tube shaped object together. The first tube shaped object is fitted with fitted with a first fitting selected from an interior screw thread or an exterior screw thread. The second tube shaped object is fitted with the remaining screw thread. The tube shaped object fitted with the exterior screw thread is placed into the remaining tube shaped object such that: 1) the interior screw thread and the exterior screw thread interconnect; and, 2) when the tube shaped object fitted with the exterior screw thread is rotated the rotational motion is converted into linear motion that moves the tube shaped object fitted with the exterior screw thread either into or out of the remaining tube shaped object. The direction of linear motion is determined by the direction of rotation.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Wheelchair: As used in this disclosure, a wheelchair is a chair fitted with two large and two small wheels. The wheelchair is commonly used for sick or disabled persons.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An apparatus comprising:

a canopy and a support structure;

wherein the apparatus attaches in a removable manner to a wheelchair;

wherein the apparatus protects an occupant of the wheelchair from the weather;

wherein the canopy forms a hood over the occupant;

wherein the supporting structure attaches the canopy to the wheelchair;

wherein the supporting structure raises the canopy above the occupant of the wheelchair;

wherein the apparatus attaches in a removable manner to a wheelchair;

wherein the apparatus protects an occupant of the wheelchair from the weather;

wherein the wheelchair further comprises right back cane, a left back cane, and a backrest;

wherein the canopy comprises a sheeting, a sheeting frame, and a plurality of pivots;

wherein the sheeting attaches to the sheeting frame;

wherein the plurality of pivots attach the sheeting frame to the support structure;

wherein the sheeting is a material selected from the group consisting of a plastic sheeting, a textile sheeting, or a composite textile sheeting;

wherein the sheeting is a flexible structure;

wherein the sheeting is a barrier between the occupant and the weather such that the sheeting will protect the occupant from the weather;

wherein the sheeting frame is a collapsible structure;

wherein the sheeting is stretched over the sheeting frame;

wherein the sheeting forms the exterior surface of the sheeting frame;

wherein the sheeting frame extends and retracts the sheeting over the occupant;

wherein the sheeting frame folds the sheeting in the manner of an accordion fold;

wherein each of the plurality of pivots is locking pivot;

wherein the support structure comprises a collection of individual clamps;

wherein the support structure further comprises a first clamp and a second clamp;

wherein each of the plurality of pivots attaches the sheeting frame to a clamp selected from the group consisting of the first clamp of the supporting structure and the second clamp of the supporting structure;

wherein each pivot selected from the plurality of pivots attaches the sheeting frame to the selected clamp in a manner that allows the sheeting frame to rotate around the pivot using the center axis of the pivot as the center of rotation of the sheeting frame;

wherein each individual clamp comprises a stanchion, a thumbscrew, an envelope, a pivot aperture, and a thumbscrew aperture;

wherein the stanchion is a vertical structure;

wherein the stanchion raises the canopy above a horizontal surface that the wheelchair is placed on;

wherein the stanchion raises the canopy above the occupant of the wheelchair;

wherein the stanchion is further defined with a first end and a second end;

wherein the second end is formed with the pivot aperture;

wherein the envelope attaches the individual clamp to the wheelchair;

wherein the thumbscrew aperture is formed in the envelope;

wherein the pivot aperture is an aperture formed through the stanchion such that the pivot inserts into the pivot aperture;

wherein the pivot aperture is an aperture formed through the stanchion such that the pivot is supported by the stanchion;

wherein the first end of the stanchion attaches to the envelope;

wherein the envelope is a structure that attaches to a cane selected from the group consisting of the right back cane of the wheelchair or the left back cane of the wheelchair;

wherein the structure of the envelope is such that the envelope will surround a portion of the selected cane in such a manner that the thumbscrew can be screwed into the selected cane to secure the envelope into position;

wherein the thumbscrew hole is a threaded aperture through which the thumbscrew can be threaded to form a threaded connection that presses into the selected cane;

wherein the canopy is formed in the shape of an arch;

wherein the pivot is selected from the group consisting of a shaft, a bearing, a hinge, or some combination items selected from the group consisting of a shaft, a bearing, or a hinge;

wherein a rear canopy is provided and extends across the first clamp and the second clamp;

wherein the rear canopy is further defined with a first, rear canopy and a second, rear canopy;

wherein the first, rear canopy is affixed to the first clamp;

wherein the second, rear canopy is affixed to the second clamp; wherein a drawstring is provided to secure the first, rear canopy to the second, rear canopy.

2. The apparatus according to claim 1 wherein the sheeting is a textile sheeting;

wherein the textile sheeting is treated with perfluorobutanesulfonic acid (CAS 375-73-5).

* * * * *